US005279492A

United States Patent [19]

Somoza et al.

[11] Patent Number: 5,279,492

[45] Date of Patent: Jan. 18, 1994

[54] PROCESS FOR REDUCING SENSITIVITY IN EXPLOSIVES

[75] Inventors: Carlos Somoza, Ft. Smith, Ark.; James A. Blackwell, Shreveport, La.

[73] Assignee: Thiokol Corporation, Ogden, Utah

[21] Appl. No.: 843,077

[22] Filed: Feb. 25, 1992

Related U.S. Application Data

[63] Continuation-in-part of Ser. No. 692,192, Apr. 26, 1991, Pat. No. 5,197,677.

[51] Int. Cl.[5] ..... B02C 19/12

[52] U.S. Cl. ..... 241/5; 241/21; 241/23; 149/109.6

[58] Field of Search ..... 241/5, 39, 40, 21, 61, 241/23; 149/109.6

[56] References Cited

U.S. PATENT DOCUMENTS

| | | | |
|---|---|---|---|
| 2,204,059 | 6/1940 | Acken . | |
| 2,852,360 | 9/1958 | By | 149/109.6 X |
| 3,069,477 | 12/1962 | Lee et al. . | |
| 3,158,331 | 11/1964 | Wilson et al. . | |
| 3,239,502 | 3/1966 | Lee et al. . | |
| 3,266,957 | 8/1966 | Stresau et al. . | |
| 3,266,958 | 8/1966 | Breazeale et al. . | |
| 3,305,414 | 2/1967 | Hodgson . | |
| 3,351,585 | 11/1967 | Lee et al. . | |
| 3,600,477 | 8/1971 | Friedel et al. . | |
| 3,754,061 | 8/1973 | Forrest et al. . | |
| 3,761,330 | 9/1973 | Lou et al. . | |
| 3,770,721 | 11/1973 | Robbins et al. . | |
| 3,937,405 | 2/1976 | Stephanoff . | |
| 4,065,529 | 12/1977 | Lavertu et al. . | |
| 4,092,187 | 5/1978 | Hildebrandt et al. | 149/11 |
| 4,115,166 | 9/1978 | Lista et al. . | |
| 4,156,593 | 5/1979 | Tarpley, Jr. . | |
| 4,265,406 | 5/1981 | Palgrave et al. . | |
| 4,410,423 | 10/1983 | Walsh . | |
| 4,462,848 | 7/1984 | Elrick . | |
| 4,533,254 | 8/1985 | Cook et al. . | |
| 4,572,439 | 2/1986 | Pitzer . | |
| 4,588,575 | 5/1986 | David . | |
| 4,588,576 | 5/1986 | David . | |
| 4,767,064 | 8/1988 | Resch . | |
| 4,783,389 | 11/1988 | Trout et al. . | |
| 5,020,731 | 6/1991 | Somoza et al. . | |
| 5,035,363 | 7/1991 | Somoza . | |

OTHER PUBLICATIONS

Suslick, K. S., "The Chemical Effects of Ultrasound," *Scientific American*, pp. 80–86 (Feb. 1989).

"Handbook of Microfluidizer Applications—A User's Guide to the Pioneering Technology for High Performance Cell Rupture, Emulsification, Dispersation, and Stabilization of Multi-phase Systems," Microfluidics Corporation (Aug., 1988).

Washington, C., "Dispersing problems of emulsion production," *Laboratory Equipment Digest* (Dec., 1987).

"Microfluidization: A new technique produces fine emulsions and dispersions," *Prepared Foods*, p. 171 (Mar., 1985).

Petino, Jr., et al., "Mass Denotation Tests of Agitated HMX Slurries," US Army Armament Research and Development Command (Oct., 1979).

(List continued on next page.)

*Primary Examiner*—Mark Rosenbaum
*Assistant Examiner*—Frances Chin
*Attorney, Agent, or Firm*—Madson & Metcalf

[57] ABSTRACT

A process for reducing the particle size of particulate crystalline energetic material such as HMX or RDX by slurrying the particulate energetic particles in an inert liquid wherein the liquid coats the surfaces of the particles and introducing the slurried energetic particles at a predetermined pressure into a Microfluidizer® high-pressure grinding chamber wherein high-pressure interparticle collision reduces the mean particle size of the energetic particles, thereby reducing the sensitivity of the energetic material.

43 Claims, 3 Drawing Sheets

OTHER PUBLICATIONS

Petino, Jr., et al., "Detonation Propagation Tests on Aqueous Slurries of RDX, HMX, M-1 and Nitrocellulose," US Army Armament Research and Development Command (Apr., 1977).

Meyer, R. et al., *Explosives*, pp. 150–153, 200–203 (1977).

Alliger, "Ultrasonic Disruption," *American Laboratory* (Oct., 1975).

"Encyclopedia of Explosives and Related Items," Picatinny Arsenal, vol. 3, pp. C 564–67 (1966).

Albus, F. E., "The Modern Fluid Energy Mill," *Chemical Engineering Progress*, vol. 60, No. 6, pp. 102–106 (Jun., 1964).

"Technical Bulletin—M-110F Reverse Flow Microfluidizer®," Microfluidics Corporation (date unknown).

Moulard et al., "The Effect of RDX Particle Size on the Shock Sensitivity of Cast PBX Formulations," pp. 248–257 (date unknown).

Albus, F. E., "Fluid Energy Grinding or Jet Milling," *Aljet Equipment Company* (date unknown).

*Unclassified Holston Defense Corporation article*, Kingsport, Tennessee report, pp. 1–2 (date unknown).

Kirk-Othmer, "Size Reduction," *Encyclopedia of Chemical Technology*, 3rd. ed., vol. 21, pp. 132–62 (date unknown).

PROCESS FOR REDUCING SENSITIVITY IN EXPLOSIVES

BACKGROUND

1. Related U.S. Application

This application is a continuation in part of application Ser. No. 07/692,192, filed Apr. 26, 1991, now U.S. Pat. No. 5,197,677, issued Mar. 30, 1993, and entitled WET GRINDING OF CRYSTALLINE ENERGETIC MATERIALS.

2. The Field of the Invention

The present invention is related to a process for reducing the sensitivity of explosive compositions. More particularly, the present invention is related to a process for reducing the particle size of explosive compositions by passing a slurry containing the explosive through a MICROFLUIDIZER® to achieve the desired reduced particle size.

3. Technical Background

Unplanned ignition of munitions is a hazard wherever munitions are made, stored or used. Ignition may occur due to fire, penetration by a bullet or fragment, a shaped charge jet or sympathetic detonation. To reduce this hazard, various means are being sought to decrease the sensitivity of energetic materials to such stimuli.

It has been discovered that explosive materials including RDX (cyclotrimethylene-trinitramine) and HMX (cyclotetramethylene tetra-nitramine) exhibit a decrease in sensitivity when the particle size from which the charge is formed is reduced below some threshold value, e.g. two to seven microns. It is believed that other newly developed energetic materials having an inherent low sensitivity may also be made further insensitive by use of very small particle size. Such materials include NTO (3 nitro-1, 2, 4-triazol-5-one) and ADNBF (7-amino-4, 6-dinitrobenzofurozan).

Class 1 RDX and Class 5 RDX are specified according to military specification MIL-R-398C as having the following particle size distributions:

| Percent Passing Through Sieve | | |
|---|---|---|
| Through U.S. Standard Sieve No. | Class 1 RDX | Class 5 RDX |
| 20 (840 microns) | 98 ± 2 | — |
| 50 (297 microns) | 90 ± 10 | — |
| 100 (149 microns) | 60 ± 30 | — |
| 200 ( 74 microns) | 25 ± 20 | — |
| 325 ( 44 microns) | — | 97+ |

The approximate mean particle sizes, based on volume, for each class are:

Class 1: 100–200 microns

Class 5: 3–10 microns

Class 1 RDX is prepared as a wet slurry. It is shipped and stored as a 75 percent solids slurry in a water-alcohol mixture, e.g. 40 percent isopropyl alcohol and 60 percent water.

Class 5 RDX is generally prepared from crude RDX by recrystallization and is more resistant to unintentional ignition because of the reduced particle size.

The most common method of preparing finely ground RDX and HMX is to thoroughly dry the wet crystallized material, typically to less than 0.1 percent moisture and perform size reduction with a fluid energy mill. Inadequate grinding of RDX and HMX is generally believed to occur when the material contains even small quantities of moisture.

Size reduction of other wet materials in a fluid energy mill is not considered feasible unless the elastic carrier fluid is at a temperature where the water-containing liquid is evaporated from the particles. For an energetic slurry of 10 to 25 percent solids, the required temperatures of the carrier fluid for wholly evaporating the water-alcohol mixture are unsafe and may result in detonation. Thus, the energetic material is predried at a lower temperature. Furthermore, dry grinding of explosive materials carries with it inherent risks of detonation. In addition, the drying process is highly energy intensive and thus, costly to operate. Detonation of nitramines have been known to occur in the drying step.

Another common method for producing RDX, HMX or CPX of smaller particle size is a recrystallization process. The original crystallization of these materials necessarily results in large particle size. The energetic material such as Class 1 RDX, for example, is produced as a highly wetted material at about 20 percent solids. A solids concentration of 80 to 85 percent in a water-alcohol solution is used for safe shipment and storage.

Recrystallization is typically conducted by dissolving the energetic material in a solvent such as cyclohexanone or acetone and precipitation by quenching with water. The recrystallization process is both tedious and excessively consumptive of both time and energy. The use of toxic volatile solvents presents well-known environmental hazards. One disadvantage of the recrystallization process is the wide range of resulting particle sizes.

Hence, what is needed in the art is a process for reducing the sensitivity in explosive compositions by reducing the particle size of the compositions, thereby reducing the possibility that unplanned ignition of the explosive will occur.

Thus, it would be an advancement in the art to provide such a process which avoids the use of substantial amounts of toxic volatile solvents.

It would be an additional advancement in the art if such a process for reducing the sensitivity in explosive compositions were available which could safely and effectively reduce the particle size of such explosive compositions.

It would be yet a further advancement in the art if such a process could reduce the particle size in explosive compositions such that the resulting size of the particles in the mixture were distributed over a narrow range.

Such a process is disclosed and claimed herein.

BRIEF SUMMARY AND OBJECTS OF THE INVENTION

The present invention is directed to an improved method for reducing the particle size of particulate energetic materials including explosives such as RDX (cyclo-1, 3, 5-tetranitramine), HMX (cyclotetramethylene tetranitramine) and the like. By reducing the particle size of these particulate energetic materials, their sensitivity is also reduced, thereby reducing the risks that ignition may occur due to fire, penetration by bullet or fragment or sympathetic detonation.

A slurry of particulate energetic material having a solids content less than 40 percent and more typically between 5 and 30 percent is pressurized with a high pressure and continuously fed through a grinding chamber of a Microfluidizer® where high-pressure, interparticle collision reduces the mean particle size.

After passing through the grinding chamber, the slurry is passed through a cooling coil and into a feed tank where the process is continued for a predetermined amount of time. The temperature of the slurry within the feed tank is monitored to ensure that the temperature is maintained within acceptable ranges.

The energetic particles are ground while in an aqueous slurry. The risks of localized hot spots leading to detonation or burning are substantially eliminated because the moisture on the particles' surfaces absorbs much of the thermal energy generated by the grinding. Also, the time of exposure of the energetic particles to the thermal energy is only a fraction of a second. Thus, the process is inherently safer than the prior art dry grinding processes. Furthermore, the time and energy expended to dry the energetic materials is avoided.

The process of the invention is much simpler, less time consuming and less expensive than the prior art recrystallization processes in current use. In addition, a narrower particle size spectrum is achieved.

Thus, it is an object of the invention to provide a process for reducing the sensitivity in explosive compositions by reducing the particle size of the compositions, thereby reducing the possibility that unplanned ignition of the explosive will occur.

It is an additional object of the present invention to provide such a process which avoids the use of substantial amounts of toxic volatile solvents.

It is a further object of the present invention to provide such a process for reducing the sensitivity in explosive compositions which safely and effectively reduces the particle size of such explosive compositions.

It is yet a further object of the present invention to provide such a process for reducing the particle size in explosive compositions such that the resulting size of the particles in the mixture are distributed over a narrow range.

These and other objects and advantages of the present invention will become more fully apparent by examination of the following description of the preferred embodiments and the accompanying drawings.

DETAILED DESCRIPTION OF THE PREFERRED EMBODIMENTS

Reference is now made to the figures wherein like parts are referred to by like numerals throughout. The two primary prior-art methods of producing fine particle energetic material, e.g. Class 5 RDX, from production run material, e.g. Class 1 RDX, are illustrated in FIGS. 1 and 2.

Figure 1:
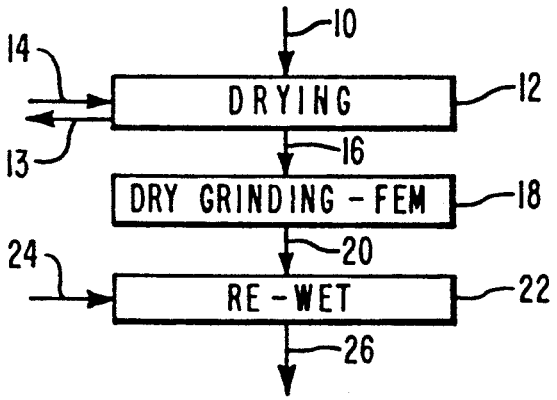
FIG. 1 (PRIOR ART)
FIG. 1 is a block diagram showing the steps of a prior art process for size reduction of energetic materials.
Figure 2:
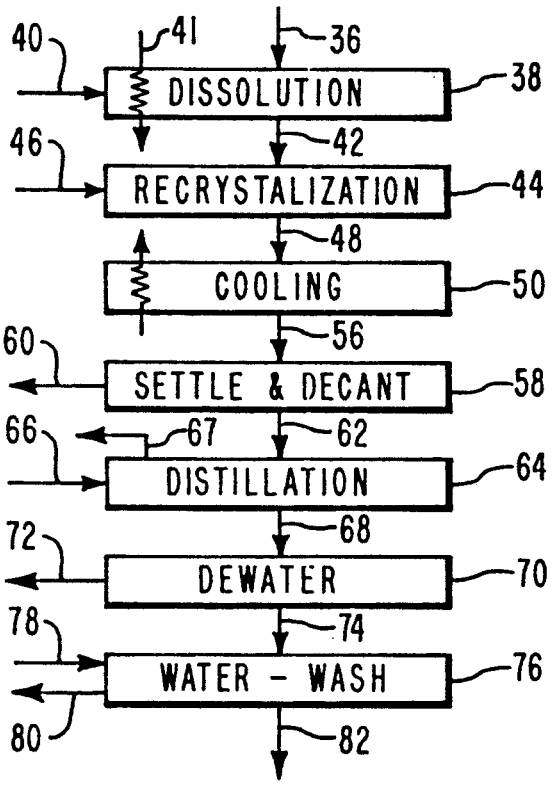
FIG. 2 (PRIOR ART)
FIG. 2 is a block diagram showing the steps of another prior art process for size reduction of energetic materials.

FIG. 1 shows a prior-art dry grinding method in current use for producing fine HMX, RDX and other energetic materials. The slurry 10 of energetic material typically contains 10 to 25 percent energetic solids mixed in an aqueous alcohol mixture. The slurry 10 is first dried in drying step 12 to drive off the water and alcohol mixture 13. Thermal energy 14 is provided for drying.

The dried energetic material 16 is then ground in a grinding mill such as a fluid energy mill in step 18.

The ground energetic material may then be re-wet in step 22 to form a slurry 26 of about 80 to 85 percent solids for storage or shipment. The wetting agent 24 is water, a mixture of water and alcohol or other inert liquid or liquids.

This prior-art process consumes very large quantities of energy 14 to dry the particulate energetic material 10. The thermal energy required to dry material of 25 percent solids is over 1,400 kilogram calories per kilogram of material.

Another commonly used method of preparing finely divided RDX is by recrystallization, as illustrated in FIG. 2. The original manufacturing step in RDX manufacture results in a large particle size crude RDX. These particles of crude RDX are recrystallized under different conditions to produce finely divided material.

In the method of FIG. 2, wet crude RDX 36, or the like, is dissolved in step 38 in acetone 40 at about 135 degrees Fahrenheit (57° C.) heated by steam 41.

The hot solution 42 is recrystallized in step 44 by quenching with water 46. The quenched material 48 is cooled in step 50. The cooled material is then settled and solvent 60 decanted in step 58.

To the settled material 62 is added water 66 in step 64, and acetone 67 is distilled off.

The solvent-free slurry 68 is then cooled to 122 degrees Fahrenheit and dewatered in step 70, discharging an aqueous stream 72 and a wet RDX stream 74 which is washed with water 78 in step 76 to remove traces of acetone 80. A water-wet slurry 82 of finely divided RDX is produced.

A somewhat similar recrystallization procedure is used for producing finely divided HMX. The recrystallization procedure is cumbersome and time consuming. In addition, large quantities of toxic solvents must be handled, repurified and disposed.

Figure 3:
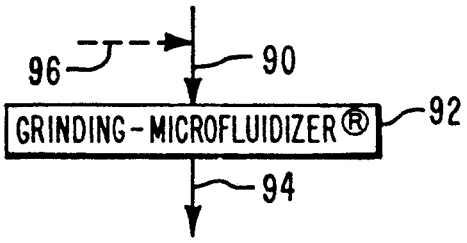
FIG. 3 is a block diagram of the invention.

The present invention is schematically depicted in FIG. 3 and comprises the single step of introducing the as produced slurry 90 of energetic material into a high-pressure grinding chamber 92, such as that produced by the Microfluidics Corporation of Newton, Mass. and sold under the trade name "Microfluidizer®." The particles are ground in the wet state and discharged as stream 94 as a slurry of finely divided particles.

If the slurry 90 of coarse particles contains less than the desired moisture content, additional water 96 or other inert liquid carrier may be added to dilute the energetic stream 90 prior to grinding.

The amount of particle size reduction to be achieved is a function of the mixed characteristics of the energetic formulation. A mean particle size below 20 microns may be satisfactory for certain formulations of insensitive high explosives. Generally, however, mean particle sizes for RDX and HMX formulations of less than four microns are sought. The present invention has been successfully utilized in obtaining mean particle sizes in such formulations of approximately one micron. And, it is presently believed that even greater reduction in particle size may be achieved in accordance with the teachings of the present invention.

Figure 4:
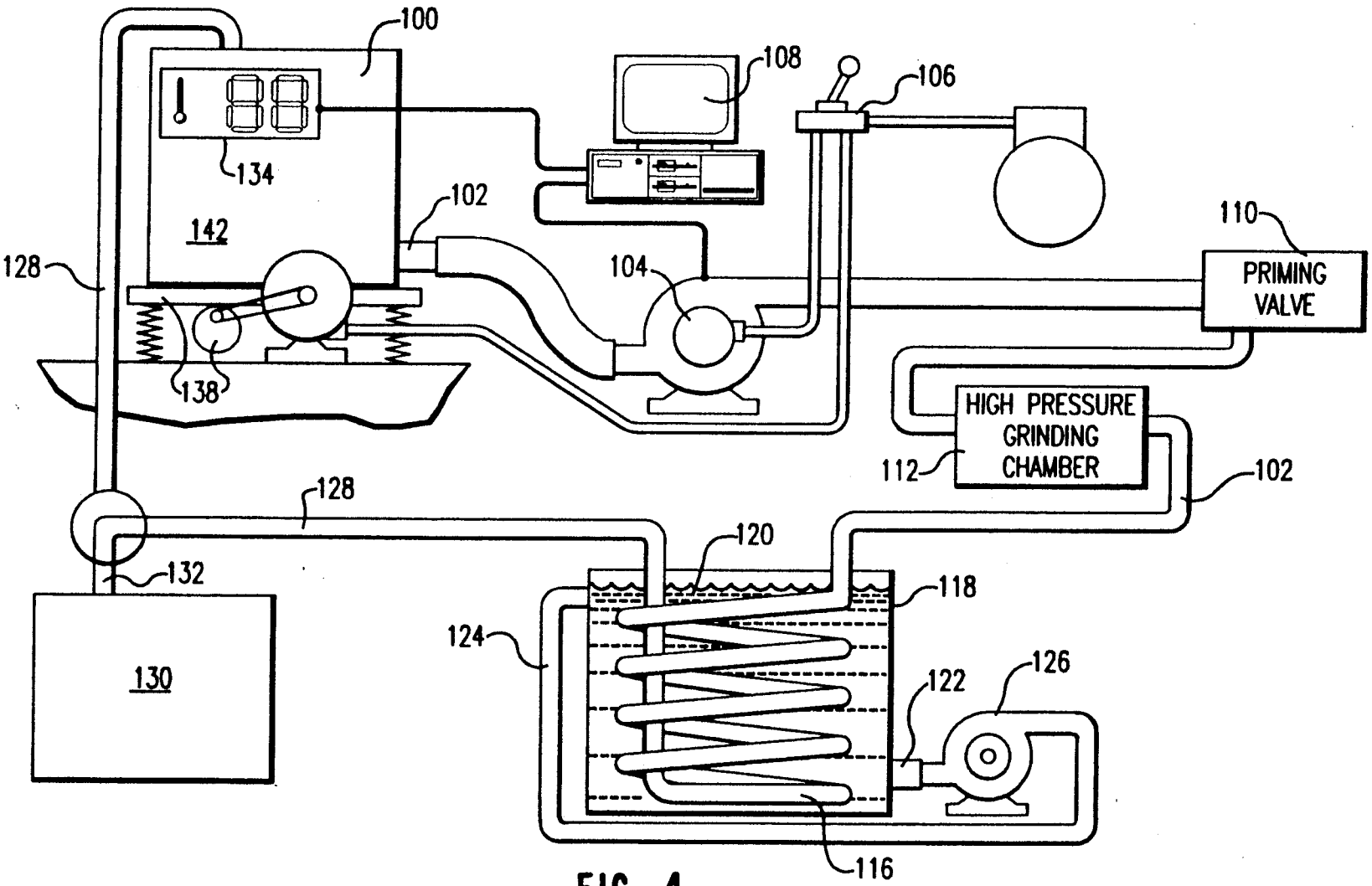
FIG. 4 is a schematic flow diagram showing the test equipment arrangement in accordance with the process of the invention.

FIG. 4 illustrates a laboratory arrangement for grinding energetic material slurries with the Microfluidizer®. The components utilized in the process of the present invention include a feed tank 100. Tubing 102 is utilized to carry the energetic slurry from one station to the next. It is presently preferred that tubing 102 be made of stainless steel as the non-sparking nature of stainless steel is particularly important when dealing with energetic materials such as those being treated in accordance with the process of the present invention.

Tubing 102 interconnects the feed tank 100 to a high-pressure pump 104. High-pressure pump 104 includes a remote air valve 106 which is actuated to start the pump 104. The portions of pump 104 which come into contact with the energetic material are made of non-corrosive and non-sparking material. A closed-circuit television 108 is provided through which the high-pressure pump 104 may be visually monitored by an operator.

A priming valve 110 is positioned downstream from the pump 104 through which air may be ejected from the system to adjust the grinding pressure at the time of start up, as will be explained below in further detail. A high-pressure grinding chamber 112 follows the priming valve 110. Within the grinding chamber 112, the particles are subjected to high-pressure interparticle collision which reduces the particle size. It is presently preferred that high-pressure grinding chamber 112 be that produced by the Microfluidics Corporation of Newton, Mass. and sold under the trade name "Microfluidizer®."

A cooling coil 116 is provided in the system at a point following the grinding chamber 112. Cooling coil 116 passes through a heat exchanger 118 filled with a fluid 120. Fluid 120 is preferably water, although one of skill in the art will appreciate that other fluids may be effectively employed in heat exchanger 118. The heat exchanger 118 includes an inlet port 122 and an exhaust port 124 through which the cooling fluid 120 enters and exits the heat exchanger 118. A cooling fluid recirculation pump 126 is included to pump the cooling water through the heat exchanger 118. All of the pumps utilized in the system, including the cooling water recirculation pump 126, are preferably driven by compressed air because the processing of energetic materials creates a potentially hazardous environment in which to use electrical pumps.

A recirculation hose 128 connects the heat exchanger 118 to the feed tank 100 to complete the continuous loop. The recirculation hose 128 may be made of the same stainless steel as tubing 102.

A receiving tank 130 is provided which is connected to the heat exchanger 118 by way of exit tubing 132. As explained in greater detail below, when the composition has reached the desired particle size by passing through the continuous process, it may be introduced into the receiving tank 130 through exit tubing 132.

A digital thermometer 134 may be included in the feed tank 100 to monitor the temperature of the slurry as it circulates through the system. The temperature data provided by the digital thermometer 134 enables the operator to ensure that slurry temperatures are maintained within acceptable limits. Also, the temperature may be monitored to evaluate the effect of temperature on the effectiveness of particle size reduction in the system.

The tubing 102 may be connected to the various components of the system with a tube connection designed to prevent contact of explosive product with threads. Rather than utilizing threads as connectors for tubing 102, however, it is preferable to utilize a quick connect flange. The use of a quick connect flange avoids the inherent hazards of utilizing threads while providing the secure connection needed.

In accordance with the process of the present invention, the system is prepared for processing energetic materials by initially following a pre-start procedure. The pre-start procedures include turning on a compressed air supply from which the various components of the system requiring compressed air are supplied, commencing the flow of cooling fluid 120 through the heat exchanger 118, turning on the closed-circuit television 108, turning on the digital thermometer 132, setting the compressed air level on the high-pressure pump 104 so the desired pressure will be produced when the high-pressure pump is actuated, turning on an agitator 138 on the feed tank 100, turning on the cooling fluid recirculation pump 126 by setting its feed pressure to a predetermined level, and priming the high-pressure pump 104 and setting the pump speed. With the pre-start procedures completed, the energetic material to be processed may be introduced into the system.

Initially, distilled water 140 is added to the feed tank 100. It will be appreciated that inert liquids other than distilled water may be utilized in making the slurry described herein. It has been found that a satisfactory slurry may be also be formed using alcohol and mixtures of water and alcohol.

With distilled water 140 in the feed tank 100, the high-pressure pump can be turned on by turning the remote air valve 106 and pressurizing the pump 104. In this mode, before any energetic materials are introduced into the system, the input pressure to the grinding chamber 112 can be adjusted by releasing pressure from the priming valve 110. The grinding pressure is determined by the input pressure generated by the high-pressure pump 104.

In a presently preferred embodiment of the invention, a grinding pressure of 17,000 psi is achieved. In this embodiment, it has been determined that the ratio of input pressure to grinding pressure is approximately 1:233; thus, to achieve a grinding pressure of 17,000 psi, an input pressure of approximately 73 psi is required. Presently preferred input pressures range from 45 to 85 psi, resulting in grinding pressures of from about 10,000 to about 18,000 psi. As a general rule, explosive compositions should not be subject to pressures greater than about 20,000 psi.

The priming valve 110 may be opened to release air from the system until an input pressure of 73 psi is achieved. With the system pressurized and before any energetic solids are added to the system, all connections in the system may be checked for leaks and any leaking connections may be tightened. The high-pressure pump 103 can then be turned off prior to adding the energetic solids to the system.

Although this pre-start procedure does not have to be utilized prior to each run of the system, the pump should be checked each time prior to adding any energetic solids to ensure that it is still primed. Importantly, the pump should be checked with the agitator turned off. Turning the agitator on with only water in the feed tank 100 causes cavitation and could result in a loss of pump prime.

After the pump 104 has been primed, the input pressure adjusted and the connections checked, the agitator may be turned on prior to adding the energetic solids. With the agitator running, energetic solids may be added to the system to form a slurry 142 with the desired solids content. It is presently preferred that a solids content of approximately 20 percent be obtained for HMX or RDX energetic materials in order to obtain a finished mean particle size of approximately one micron.

The solids content is largely a function of the desired finished particle size and the hardness of the material being processed. For example, if a mean particle size of no less than 40 microns in an RDX material is acceptable, the solids content may be 40 percent or higher.

With the slurry 142 in the feed tank 100, the operator may move to a remote location where the high-pressure pump 104 is actuated by turning on the remote air valve 106 as the pump is visually monitored over the closed-circuit television 108. The operator should visually monitor the system to ensure that flow has commenced and that no plugging of the tubing 102 between the feed tank 100 and the high-pressure pump 104 occurs. The agitation speed may have to be adjusted to prevent settling of the energetic material in the feed tank 100, particularly with larger particle size product such as that having a particle size of Class 1 RDX.

With the high-pressure pump turned on, the energetic slurry 142 is fed through the tubing 102 and introduced to the high-pressure grinding chamber 12 at a predetermined input pressure. As previously indicated, the high-pressure grinding chamber 12 is preferably a Microfluidizer® grinding apparatus. The Microfluidizer® is a particle size reduction apparatus which relies on interparticle collision at high pressure for the breaking of the particles.

The Microfluidizer® has no moving parts. The high-pressure pump 104 forces the slurry through a ceramic insert with an orifice having a specific diameter, resulting in increased pressure conditions as the slurry passes through the orifice. As previously referenced, in one presently preferred embodiment of the invention a grinding pressure of 17,000 psi is preferred. A grinding pressure of this magnitude is obtained by charging the system with an input pressure of 73 psi. Particle size reduction is achieved through mechanical grinding caused by high-pressure cavitation and impingement of the particles on each other as they pass through the orifice of the Microfluidizer®.

If the grinding pressure is not sufficiently high or if the orifice in the ceramic insert of the grinding chamber is too small, the product will plug the grinding chamber 112 and the system will not operate. The size of the orifice in the ceramic insert of the grinding chamber and the grinding pressure should be selected in accordance with the beginning particle size of the energetic solid being processed by the system.

The Microfluidizer® is made from corrosion-resistant materials. The slurry is in contact with stainless steel, glass, ceramic (in the grinding chamber) and O-rings and seals which can be selected to give a suitable solvent resistance. The Microfluidizer® is driven by compressed air, the use of which greatly reduces ignition hazards when dealing with potentially volatile compositions such as those processed in accordance with the teachings of the present invention.

After passing through the high-pressure grinding chamber 112, the energetic slurry 142 then enters the heat exchanger 118 at the inlet port 122, circulates through the heat exchanger and exits at the exhaust port 124. Because the grinding procedure is not 100 percent efficient, some of the energy within the grinding chamber is converted into heat. By passing the energetic slurry 142 through the heat exchanger 118, all or part of the heat added to the slurry in the grinding chamber 112 may be removed by the heat exchanger 118. Heat exchanger 118 may be any heat exchanger known in the art for use in cooling liquids or slurried formulations, such as many which are currently available commercially.

Processing temperatures of HMX and RDX may safely be as high as 250 degrees Fahrenheit. Consequently, the heat exchanger 118 should be configured to remove at least enough heat from the slurry to ensure that operating temperatures will remain below 250 degrees Fahrenheit. In one embodiment of the invention, the temperature of the slurry entering the high-pressure grinding chamber 112 is approximately 110 degrees Fahrenheit. In this embodiment, the heat exchanger 118 is configured to allow an approximate 50 degree Fahrenheit temperature rise in the slurry in continuous operation wherein mean particle size is reduced from approximately 150 microns to approximately one micron. The heat exchanger may also be utilized to control the temperature of the slurry in order to evaluate the effects of temperature on particle size reduction.

Upon emergence from the heat exchanger 118 through exhaust port 124, the slurry is returned to the feed tank 100 through the recirculation hose 128 where the cycle is continued. The digital thermometer 124 located in the feed tank 100 measures the temperature of the slurry. By knowing the temperature in the feed tank 100, the operator of the system can monitor to ensure that the heat exchanger 118 is functioning correctly and can verify that operating temperatures are within an acceptable and safe range.

A particle size analyzer (not shown) could be introduced into the line, preferably at any point following the high-pressure grinding chamber 112 but before the high-pressure pump 104. The lines from the exit of the high-pressure grinding chamber 112 to the high-pressure pump are low-pressure lines and therefore could easily accommodate the introduction of a particle size analyzer.

The use of a particle size analyzer within the system would enable the operator of the system to constantly monitor the progress of the system to determine the optimum time at which to shut down the continuous operation of the system. However, if the same grade of energetic solids are repeatedly processed with the system, such continuous particle size feedback may be unnecessary as the minimum processing time to achieve a desired particle size will typically be known.

After circulating the slurry through the system a predetermined time, all or a portion of the slurry may be removed from the system through exit tubing 132 and fed into the receiving tank 130. Samples of the slurry may then be taken and tested according to known methods of determining particle size to verify that the desired particle size has been achieved.

The process of the present invention may be operated as either an open or a closed system. In some applications it may be desirable to pass material through the high-pressure grinding chamber 112 only once. Thus, all of the energetic material would be removed from the system through exit tubing 132 after a single pass through the high-pressure grinding chamber 112. Unprocessed energetic material would constantly be introduced into the feed tank 100 to provide a constant supply of material circulating through the system.

The primary application of this invention is the grinding of crystalline energetic materials, i.e. RDX, HMX, etc., for use in explosives. Such materials are available as relatively large particles in a water/alcohol solution at about 80 to 85 percent solids by weight. For example, Class 1 RDX with a mean particle size of about 100 to 200 microns is available as a slurry in a mixture of water and alcohol at about 80 to 85 percent solids.

EXAMPLES

The following examples are given to illustrate various embodiments which have been made or may be made in accordance with the present invention. These examples are given by way of example only, and it is to be understood that the following examples are not comprehensive or exhaustive of the many types of embodiments of the present invention which can be prepared in accordance with the present invention.

EXAMPLE 1

Samples of RDX and CPX explosives were slurried in a liquid to place the solids in an aqueous suspension. The aqueous suspension was then fed into the feed container of the Microfluidizer ® where it was agitated. The grinding procedure was initiated by remotely starting the pumping unit of the Microfluidzer ®. The samples were pressurized from about 10,000 psig to about 16,000 psig. The aqueous suspension was pumped through the grinding chamber and then recirculated into the feed container. The aqueous suspension was recirculated continuously through the grinding chamber of the Microfluidizer ® for the time specified. Following grinding in the Microfluidizer ® for the indicated period of time, the mean particle size of the samples was measured using a Mine Safety Appliance (MSA) particle size analyzer and the following results obtained.

| RDX Weight | Grind Time | % SOLIDS | AVG. SIZE | FLUID |
|---|---|---|---|---|
| 250 gm | 60 min | 25 | 2.5 μm | Distilled Water |
| 250 gm | 60 min | 25 | 2.5 μm | Distilled Water |
| 250 gm | 60 min | 25 | 2.5 μm | Distilled Water |
| 250 gm | 75 min | 25 | 3.0 μm | Distilled Water |
| 250 gm | 75 min | 25 | 3.0 μm | Distilled Water |
| 250 gm | 75 min | 25 | 3.0 μm | Distilled Water |
| 250 gm | 75 min | 25 | 3.0 μm | Distilled Water |
| 250 gm | 75 min | 25 | 3.5 μm | Distilled Water |
| 250 gm | 75 min | 25 | 4.0 μm | Distilled Water |
| 250 gm | 75 min | 25 | 2.6 μm | Distilled Water |
| 250 gm | 75 min | 25 | 3.5 μm | Distilled Water |
| 75 gm | 75 min | 8 | 2.2 μm | Distilled Water |
| 75 gm | 75 min | 8 | 2.1 μm | Distilled Water |
| 75 gm | 75 min | 8 | 3.3 μm | Distilled Water |
| 250 gm | 75 min | 25 | 4.2 μm | Distilled Water |
| 250 gm | 75 min | 25 | 5.0 μm | Distilled Water |
| 250 gm | 75 min | 25 | 4.3 μm | Distilled Water |
| 250 gm | 75 min | 25 | 5.0 μm | Distilled Water |
| 250 gm | 75 min | 25 | 5.4 μm | Distilled Water |
| 250 gm | 75 min | 25 | 4.8 μm | Distilled Water |
| 100 gm | 75 min | 10 | 4.6 μm | Distilled Water |
| 100 gm | 75 min | 10 | 4.6 μm | Distilled Water |
| 250 gm | 120 min | 25 | 5.7 μm | Distilled Water |
| 250 gm | 120 min | 25 | 5.8 μm | Distilled Water |

-continued

| CPX Weight | Grind Time | % SOLIDS | AVG. SIZE | FLUID |
|---|---|---|---|---|
| 200 gm | 75 min | 25 | 3.3 μm | Distilled Water |
| 250 gm | 75 min | 25 | 3.2 μm | Distilled Water |
| 250 gm | 75 min | 25 | 3.4 μm | Sodium Bicarbonate |
| 250 gm | 75 min | 25 | 3.0 μm | Sodium Bicarbonate |
| 250 gm | 75 min | 25 | 2.6 μm | Distilled Water |
| 250 gm | 75 min | 25 | 3.5 μm | Distilled Water |

EXAMPLE 2

Samples of RDX explosives were slurried in distilled water to place the solids in an aqueous suspension. The aqueous suspension contained 25 percent solids by weight. The aqueous suspension was then fed into the feed container of the Microfluidizer ® where it was agitated. The grinding procedure was initiated by remotely starting the pumping unit of the Microfluidizer ®. The samples were pressurized at 10,000 psig, with one sample pressurized to about 16,000 psig. The aqueous suspension was pumped through the grinding chamber and then recirculated into the feed container. The aqueous suspension was recirculated continuously through the grinding chamber of the Microfluidizer ® for the time specified. Following grinding in the Microfluidizer ® for the indicated period of time, the mean particle size of the samples was measured using a Mine Safety Appliance (MSA) particle size analyzer.

| Grind Time | Mean Particle Size |
|---|---|
| 5 min. | 8.84 μm |
| 10 min. | 6.68 μm |
| 15 min. | 6.29 μm |
| 20 min. | 5.82 μm |
| 25 min. | 4.62 μm |
| 30 min. | 3.53 μm |
| 35 min. | 3.28 μm |
| 40 min. | 3.00 μm |
| 45 min. | 2.78 μm |
| 50 min. | 2.33 μm |
| 55 min. | 1.76 μm @ ≈16,000 psig |

EXAMPLE 3

Figure 5:
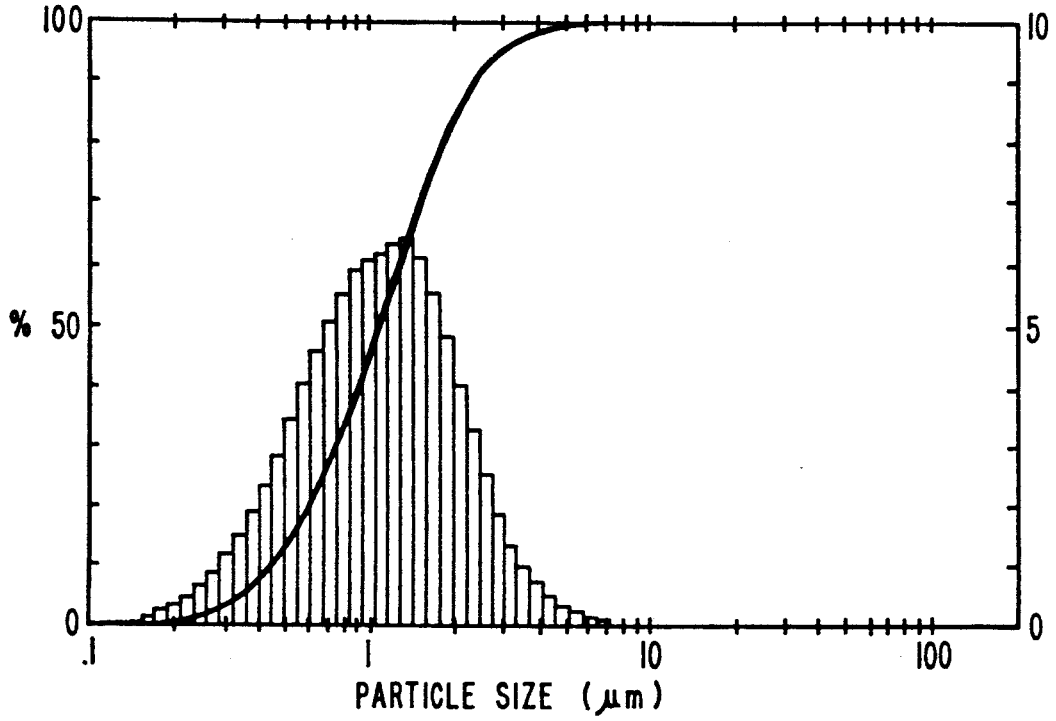
FIG. 5 is a graphical representation of the particle size distribution of an RDX slurry processed according to the present invention as set forth in Example 3.

A sample of RDX explosives was slurried in distilled water to place the solids in an aqueous suspension. The aqueous suspension contained 20 percent solids by weight. The aqueous suspension was then fed into the feed container of the Microfluidizer ® where it was agitated. The grinding procedure was initiated by remotely starting the pumping unit of the Microfluidizer ®. The sample was pressurized at 17,000 psig. The aqueous suspension was pumped through the grinding chamber and then recirculated into the feed container. The aqueous suspension was recirculated continuously through the grinding chamber of the Microfluidizer ® for 60 minutes. Following grinding in the Microfluidizer ®, the mean particle size of the sample was measured using a Malvern Instrument particle size analyzer. The mean particle size was 1.07 μm with 90 percent of the sample less than 2.35 μm. The graph illustrated in FIG. 5 illustrates the particle size distribution curve of the sample.

EXAMPLE 4

Figure 6:
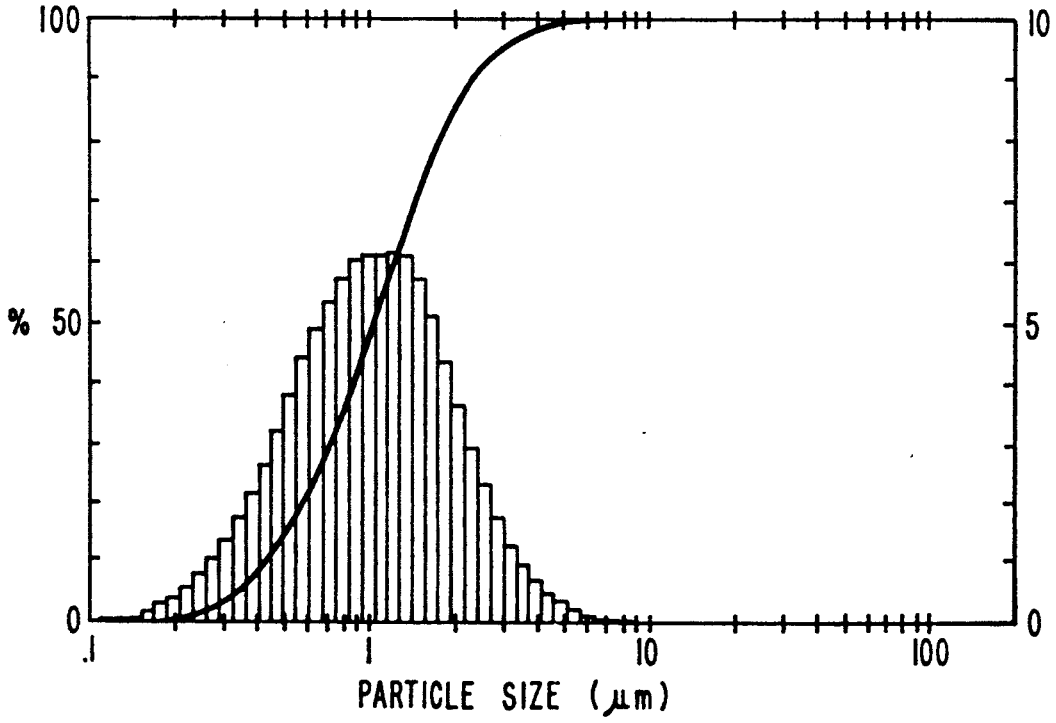
FIG. 6 is a graphical representation of the particle size distribution of an RDX slurry processed according to the present invention as set forth in Example 4.

A sample of RDX explosives was slurried in distilled water to place the solids in an aqueous suspension. The aqueous suspension contained 20 percent solids by weight. The aqueous suspension was then fed into the feed container of the Microfluidizer® where it was agitated. The grinding procedure was initiated by remotely starting the pumping unit of the Microfluidizer®. The sample was pressurized at 17,000 psig. The aqueous suspension was pumped through the grinding chamber and then recirculated into the feed container. The aqueous suspension was recirculated continuously through the grinding chamber of the Microfluidizer® for 60 minutes. Following grinding in the Microfluidizer®, the mean particle size of the sample was measured using a Malvern Instrument particle size analyzer. The mean particle size was 1.01 μm with 90 percent of the sample less than 2.28 μm. The graph illustrated in FIG. 6 illustrates the particle size distribution curve of the sample.

From the foregoing, it can be seen that the present invention provides a process for reducing the sensitivity in explosive compositions by reducing the particle size of the compositions, thereby reducing the possibility that unplanned ignition of the explosive will occur. The process of the invention is much simpler, less time consuming and less expensive than the prior art recrystallization processes in current use. In addition, a narrower particle size spectrum is achieved. The invention avoids the use of substantial amounts of toxic volatile solvents to safely and effectively reduce particle size.

It should be appreciated that the process of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A process for reducing the particle size of particulate crystalline energetic material, comprising:

slurrying the energetic particles in an inert liquid wherein the liquid coats the surfaces of the particles; and introducing the slurried energetic particles at a predetermined pressure into a Microfluidizer® high-pressure grinding chamber wherein high-pressure interparticle collision reduces the mean particle size of the energetic particles.

2. The process of claim 1, wherein said slurrying step comprises slurrying the energetic particles in an inert liquid comprising water.

3. The process of claim 1, wherein said slurrying step comprises slurrying the energetic particles in an inert liquid comprising a mixture of alcohol and water.

4. The process of claim 1, wherein said slurrying step comprises slurrying the energetic particles in an inert liquid to a solids content of less than about 40 percent.

5. The process of claim 4, wherein said slurrying step comprises slurrying the energetic particles to a solids content of between about five percent and about 30 percent.

6. The process of claim 5, wherein said slurrying step comprises slurrying the energetic particles to a solids content of between about 20 percent and about 25 percent.

7. The process of claim 1, wherein said slurrying step comprises slurrying crystalline energetic particles comprising an explosive material.

8. The process of claim 7, wherein said slurrying step comprises slurrying crystalline energetic particles comprising at least one of the group of compositions comprising RDX, HMX and CPX.

9. The process of claim 1, wherein the predetermined pressure is between about 45 psi and about 85 psi, resulting in a pressure within the grinding chamber of between about 10,000 psi to about 18,000 psi.

10. The process of claim 9, wherein the predetermined pressure is about 73 psi, resulting in a pressure within the grinding chamber of about 17,000 psi.

11. The process of claim 1, further comprising the step of monitoring the temperature of the slurry.

12. The process of claim 1, wherein the step of introducing the slurried energetic particles into a high-pressure grinding chamber is followed by the step of cooling the slurry by passing the slurry through a heat exchanger.

13. The process of claim 1, wherein said slurrying step includes introducing the inert liquid into a feed tank, agitating the liquid and introducing energetic particles into the liquid to form a slurry.

14. A continuous process for reducing the particle size of particulate crystalline energetic material, comprising:

introducing an inert liquid into a feed tank;

agitating the feed tank;

introducing energetic particles into the inert liquid in the feed tank to form a slurry wherein the inert liquid coats the surfaces of the energetic particles;

introducing the slurried energetic particles at a predetermined pressure into a high-pressure grinding chamber wherein high-pressure interparticle collision reduces the mean particle size of the energetic particles; and directing the slurry upon exit of the slurry from the high-pressure grinding chamber back into the feed tank where the slurry can be recirculated through the high-pressure grinding chamber.

15. The continuous process of claim 14, further comprising the step of recirculating the slurry through the high-pressure grinding chamber until the mean particle size of the energetic material is less than about 20 microns.

16. The continuous process of claim 15, wherein said recirculating step comprises recirculating the slurry through the high-pressure grinding chamber until the mean particle size of the energetic material is less than about 4 microns.

17. The continuous process of claim 16, wherein said recirculating step comprises recirculating the slurry through the high-pressure grinding chamber until the mean particle size of the energetic material is about one micron.

18. The continuous process of claim 14, wherein said step of introducing an inert liquid into a feed tank comprises introducing an inert liquid comprising water.

19. The continuous process of claim 18, wherein said step of introducing an inert liquid into a feed tank comprises introducing an inert liquid comprising a mixture of alcohol and water.

20. The continuous process of claim 14, wherein said step of introducing energetic particles into the inert liquid in the feed tank to form a slurry comprises slurrying the energetic particles to a solids content of less than about 40 percent.

21. The continuous process of claim 20, wherein said step of introducing energetic particles into the inert liquid in the feed tank to form a slurry comprises slurrying the energetic particles to a solids content of between about five percent and about 30 percent.

22. The continuous process of claim 21, wherein said step of introducing energetic particles into the inert liquid in the feed tank to form a slurry comprises slurrying the energetic particles to a solids content of between about 20 percent and about 25 percent.

23. The continuous process of claim 14, wherein said step of introducing energetic particles into the inert liquid comprises introducing crystalline energetic particles comprising an explosive material.

24. The continuous process of claim 23, wherein said step of introducing energetic particles into the inert liquid comprises introducing crystalline energetic particles comprising at least one of the group of compositions comprising RDX, HMX and CPX.

25. The continuous process of claim 14, wherein the predetermined pressure is between about 45 psi and about 85 psi, resulting in a pressure within the grinding chamber of between about 10,000 psi to about 18,000 psi.

26. The continuous process of claim 25, wherein the predetermined pressure is about 73 psi, resulting in a pressure within the grinding chamber of about 17,000 psi.

27. The continuous process of claim 14, further comprising the step of monitoring the temperature of the slurry.

28. The continuous process of claim 14, wherein the step of introducing the slurried energetic particles into a high-pressure grinding chamber is followed by the step of cooling the slurry by passing the slurry through a heat exchanger.

29. The continuous process of claim 14, wherein the step of introducing the slurried energetic particles into a high-pressure grinding chamber is followed by the step of analyzing a portion of the particles to determine their size.

30. The continuous process of claim 14, wherein after the process has been operating for a predetermined period of time, the step of directing the slurry upon exit of the slurry from the high-pressure grinding chamber back into the feed tank is discontinued and the slurry is directed into a receiving tank.

31. A continuous process for reducing the particle size of particulate explosive material, comprising:

introducing water into a feed tank;

agitating the feed tank;

introducing particles of explosive materials to the water in the feed tank to form a slurry with a solids content of less than about 40 percent, wherein the water coats the surfaces of the explosive particles;

introducing the slurried explosive particles at a predetermined pressure into a Microfluidizer® high-pressure grinding chamber wherein high-pressure interparticle collision reduces the mean particle size of the explosive particles; and directing the slurry upon exit of the slurry from the high-pressure grinding chamber back into the feed tank where the slurry can be recirculated through the system.

32. The continuous process of claim 31, further comprising the step of recirculating the slurry until the mean particle size of the explosive particles is less than about 20 microns.

33. The continuous process of claim 32, wherein said recirculating step comprises recirculating the slurry until the mean particle size of the explosive particles is less than about 4 microns.

34. The continuous process of claim 33, wherein said recirculating step comprises recirculating the slurry until the mean particle size of the explosive particles is about one micron.

35. The continuous process of claim 31, wherein said step of introducing particles of explosive materials to water in the feed tank to form a slurry comprises slurrying the explosive particles to a solids content of between about five percent and about 30 percent.

36. The continuous process of claim 35, wherein said step of introducing particles of explosive materials to water in the feed tank to form a slurry comprises slurrying the explosive particles to a solids content of between about 20 percent and about 25 percent.

37. The continuous process of claim 31, wherein said step of introducing particles of explosive materials to the water comprises introducing explosive particles comprising at least one of the group of compositions comprising RDX, HMX and CPX.

38. The continuous process of claim 31, wherein the predetermined pressure is between about 45 psi and about 85 psi, resulting in a pressure within the grinding chamber of between about 10,000 psi to about 18,000 psi.

39. The continuous process of claim 38, wherein the predetermined pressure is about 73 psi, resulting in a pressure within the grinding chamber of about 17,000 psi.

40. The continuous process of claim 31, further comprising the step of monitoring the temperature of the slurry.

41. The continuous process of claim 40, wherein the step of introducing the slurried energetic particles into a Microfluidizer® high-pressure grinding chamber is followed by the step of cooling the slurry by passing the slurry through a heat exchanger.

42. The continuous process of claim 31, wherein the step of introducing the slurried energetic particles into a Microfluidizer® high-pressure grinding chamber is followed by the step of analyzing a portion of the particles to determine their size.

43. The continuous process of claim 31, further comprising the step of directing the slurry upon its exit from the high-pressure grinding chamber into a receiving tank and discontinuing said step of directing the slurry upon exit of the slurry from the high-pressure grinding chamber back into the feed tank.

* * * * *